United States Patent [19]

Nolte

[11] Patent Number: 4,927,988

[45] Date of Patent: May 22, 1990

[54] ENCLOSED SWITCH CONTACT ASSEMBLY

[75] Inventor: Duane R. Nolte, Wausau, Wis.

[73] Assignee: Marathon Electric Mfg. Corp., Wausau, Wis.

[21] Appl. No.: 300,324

[22] Filed: Jan. 23, 1989

[51] Int. Cl.[5] ..... H01H 35/10

[52] U.S. Cl. ..... 200/80 R; 73/538; 200/302.1; 310/68 E

[58] Field of Search ..... 73/535–538; 318/462, 793; 310/68 E; 200/80 R, 302.1, 304, 306, 283

[56] References Cited

U.S. PATENT DOCUMENTS

| | | | |
|---|---|---|---|
| 2,662,143 | 12/1953 | Eckles . | |
| 2,795,678 | 6/1957 | Mertler . | |
| 2,813,180 | 11/1957 | Hantack . | |
| 2,816,199 | 12/1957 | Staak et al. . | |
| 2,925,479 | 2/1960 | Marasco . | |
| 3,015,011 | 12/1961 | Seagreaves . | |
| 3,433,908 | 3/1969 | Cunningham | 200/80 R |
| 3,678,235 | 7/1972 | Anderson . | |
| 3,691,415 | 9/1972 | Hancock et al. . | |
| 3,950,628 | 4/1976 | Hruda | 200/302.1 |
| 4,002,868 | 1/1977 | Jooss et al. . | |
| 4,095,073 | 6/1978 | Frank . | |
| 4,240,001 | 12/1980 | Hildebrandt et al. . | |
| 4,284,864 | 8/1981 | Crow et al. . | |
| 4,414,443 | 11/1983 | Dehrt . | |
| 4,504,710 | 3/1985 | Bryant et al. . | |
| 4,658,196 | 4/1987 | Hildebrandt . | |

*Primary Examiner*—Gerald P. Tolin

[57] ABSTRACT

A centrifugal switch assembly for a single phase induction motor connects a start winding in circuit to start the motor. A centrifugal actuator positions a movable contact on the end of a cantilevered spring arm relative to an aligned fixed switch carried by an insulating flat plate secured within the motor. A silicone rubber boot in the form of a tubular member has a first heavy end telescoped over the movable contact with a resilient gripping of the side of the contact. The opposite end of the boot is a heavy end which is freely telescoped over the opposite contact into engagement with the flat plate to totally enclose the contacts, but may also be attached to the contact with a resilient grip. The boot has an intermediate convolution between the two ends. The convolution is formed as a very thin wall to establish a highly flexible but supporting wall member. The boot length is greater than the spacing of the open contacts and the convolution is continuously deflected to create a compressive support of the boot between the flat plate and the movable contact. The contacts open to de-energize the circuit during the starting of the motor. The boot may have more than one convolution between the mounting the fixed contact ends. The boot is formed from a special silicone rubber and is specially processed and stored in a sealed enclosure prior to assembly.

12 Claims, 2 Drawing Sheets

FIG. 1
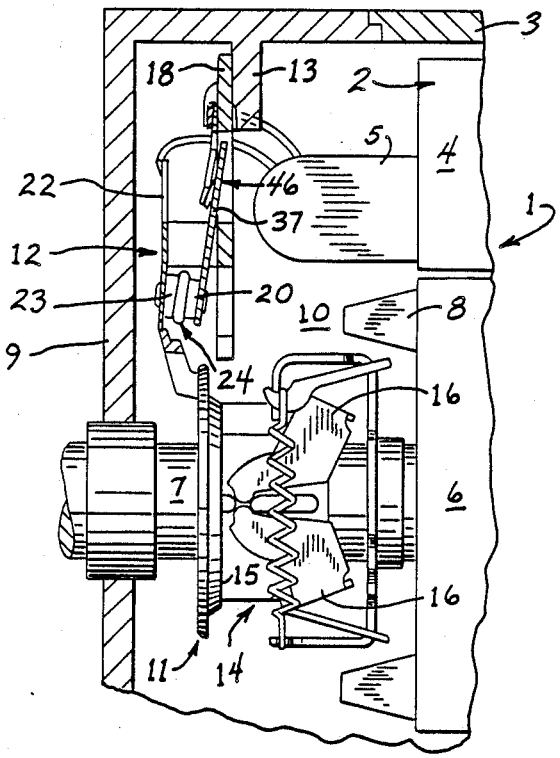
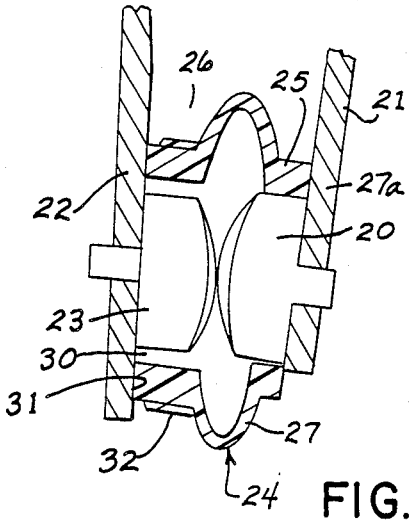
FIG. 3
FIG. 2
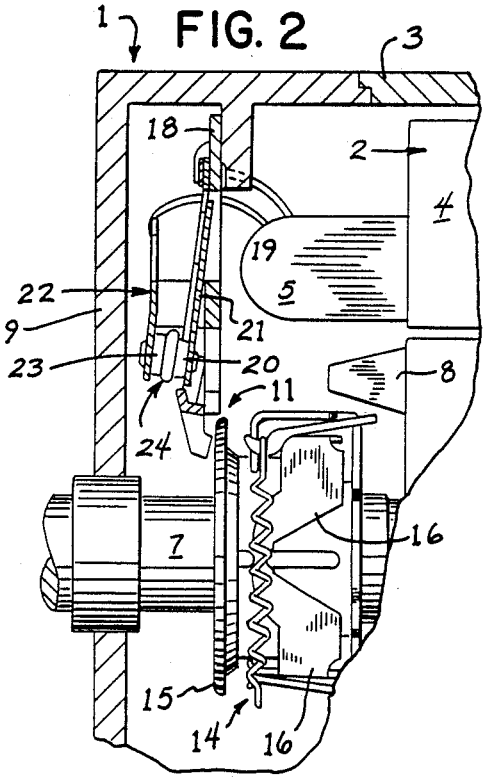
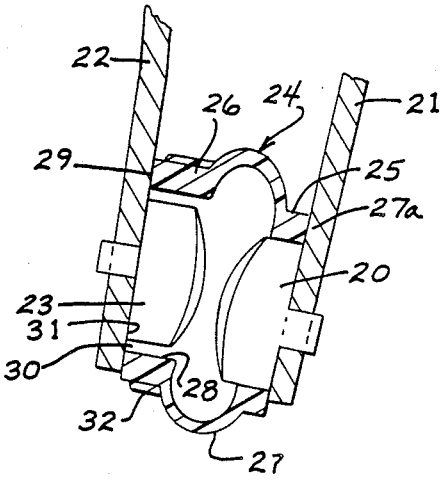
FIG. 4

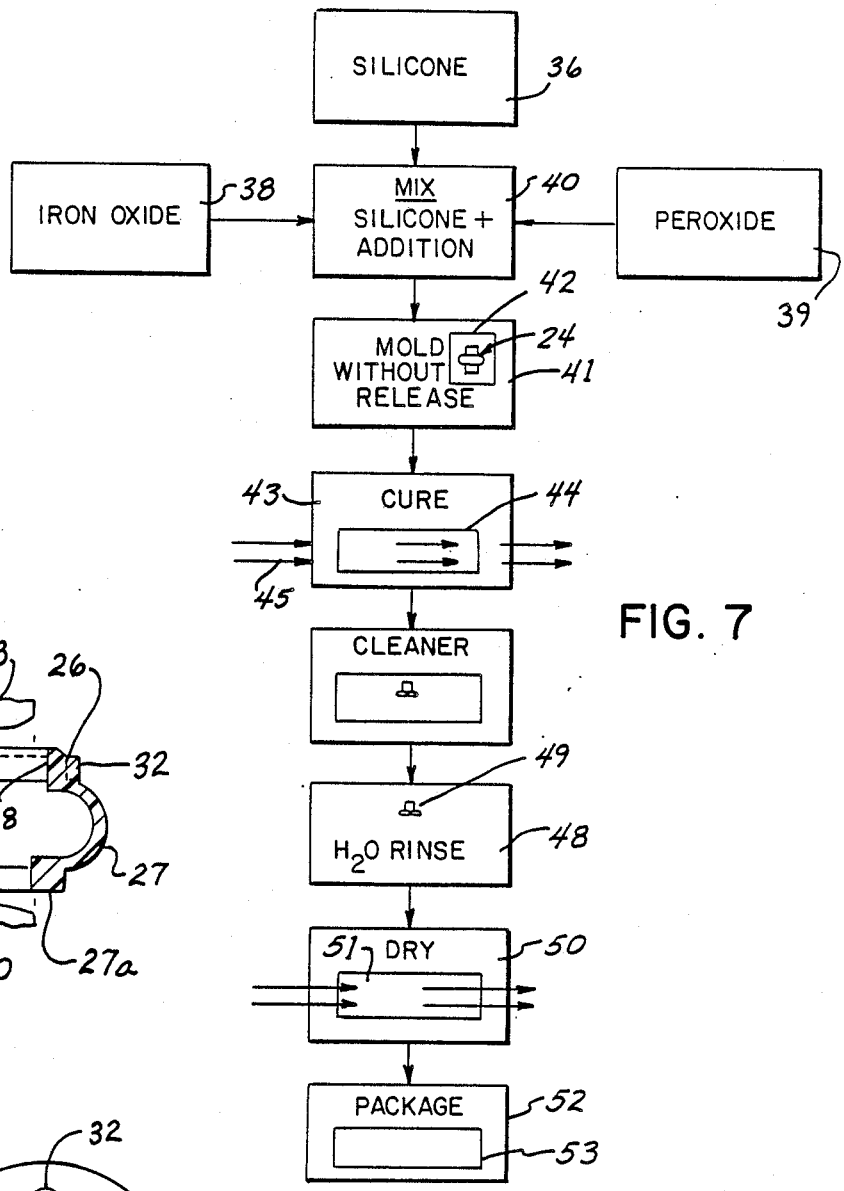
FIG. 7
FIG. 5
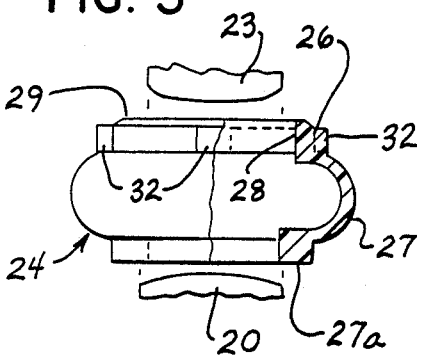
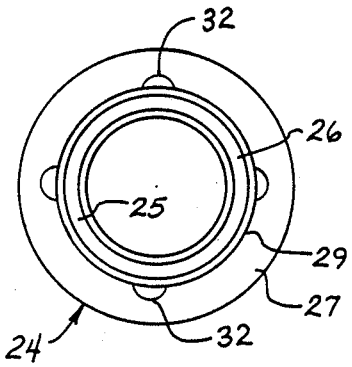
FIG. 6

ENCLOSED SWITCH CONTACT ASSEMBLY

BACKGROUND OF THE PRESENT INVENTION

This invention relates to an enclosed switch contact assembly and particularly to such a contact assembly forming an integrated component of an electric motor.

Switched electric motors operate in many different environments and often require ventilation to maintain long satisfactory life. The motors may operate in various adverse environments such as airborne contaminants including chemical substances, foreign particles and the like. Other motors are operated in high humidity environments. Switch assemblies used in the various contaminated environments may be subject to rapid deterioration as a result of the foreign matter in the environment.

Typically, a motor used to drive power equipment such as a table saw or the like operates in a highly contaminated environment. The fine sawdust for example will be carried by the air into the motor structure. A clothes dryer operates in an environment of both fine lint and high humidity. In a gas fired dryer, a motor actuated switch assembly may include two sets of contacts. A first set of contacts controls the induction motor start circuit and a second set of contacts controls a gas solenoid for the gas burner. Other applications will encounter similar problems, and even though not directly associated with a source of contaminants, may be subject to particulate, moisture and other contaminants as the result of the general working environment.

The airborne contaminates are carried about the motor and through the motor's ventilation system. In certain applications, corrosive chemicals reactions with contaminants may result and in most applications the contaminant adversely affect the switching function. A widely used motor is of a single phase induction motor design wherein a switch assembly is mounted within the motor structure and completes a start winding circuit only during the starting of the motor. A suitable device such as a centrifugal actuator is provided for opening of switch contacts to disconnect the start winding circuit after the motor accelerates to an appropriate speed. Various centrifugally actuated switches have been commercially developed for holding the contacts closed in the start position and automatically moving them to an open position at a selected appropriate speed. A particularly satisfactory switch actuating assembly is disclosed in the U.S. Pat. No. 4,419,550 which issued to Gerald J. Monette on Dec. 6, 1983. The switch structure includes a multiple arm leaf spring member secured to a rigid mounting plate within the motor end frame. The spring member includes a cantilevered contact arm with a button contact in opposed relation to a small button contact on the plate. A centrifugal actuator on the motor shaft is coupled to the leaf spring mount unit and is operable to hold the contact closed in the initial start position. The centrifugal actuator retracts under centrifugal forces as the motor accelerates and releases the leaf spring contact which rapidly snaps to the open position thereby disconnecting of the motor circuit. The contacts in accordance with various open motor constructions are exposed within the motor housing. In environments carrying airborne contaminants, the foreign matter can significantly adversely effect the functioning of the switch assembly. The various contaminants and airborne particles may for example change and increase the contact resistance resulting in increased heating of the contacts, as well as accelerating oxidation of the contacts with corresponding changes in the conductivity characteristic. These, and other results depending upon the particular environment can often lead to premature switch malfunction and eventually to premature switch failure.

Various solutions have been suggested. A "totally enclosed motor" construction can be provided wherein the outer motor frame is essentially sealed such that airborne particulates, contaminants and the like are totally or significantly excluded from the motor. In such motors, the motor is essentially formed with an outer enclosure which prevents outside air and foreign matter carried thereby from entering and circulating within the motor enclosure. Such motors however are generally quite costly and form an alternative to opened drip-proof motor of the same horsepower rating. Drip-proof and open enclosure motor construction are significantly less costly. The drip-proof motor will normally have a protective covering which will protect the direct entry of contaminants or the like into the motor but otherwise function in much the same manner of an open motor which allows free movement of the airborne products into the motor. The open-construction of the motor more readily dissipates heat and can be constructed as a more compact motor. A totally enclosed motor generally requires an elongated rotor and core construction to dissipate the same heat at the same horsepower rating. Such additional length in the stator rotor and stator require additional steel in the core structures, copper in the winding structures and the like, and consequently adds significant material cost as well producing a larger motor.

Thus, it would be desirable to provide an effectively open motor structure for a switched motor such as the widely used single phase induction motors for use in such adverse environmental conditions.

As an alternate to the relative costly totally enclosed motors, the prior art has suggested the use of a drip-proof or open type of motor construction including a specially enclosed start switch assembly to protect the switch contacts from contamination and thereby permit use of the open motor in environments containing airborne contaminants and particles. For example, U.S. Pat. No. 2,816,199 which issued Dec. 10, 1957 discloses a starting switch assembly including a dustproof switch mechanism. In the latter patent, a fixed contact is mounted in opposed relation to a contact carried by a spring arm with a centrifugal actuator to position the movable contact between an open and closed position. An outer flexible cup-shaped enclosure is located between the mounting plate and the spring arm. The cup has a closed end abutting the mounting plate and projects outwardly with the outer open end secured to a spring arm. The side wall of the cup is provided with a slot to permit telescoping of the cup-shaped enclosure upwardly over the fixed contact and its supporting arm. The outer open end of the cup-shaped member includes projections which mate with openings in the spring arm for the movable contact and the lugs are forced through the openings in the member and secure the cup-shaped member to the contact spring arm. The cup-shaped member is formed of a flexible material such as a silicone rubber which collapses as the centrifugal actuator moves the leaf spring arm towards the fixed contact to close the switch. Another contact enclosure for a centrifugally actuated switch is illustrated in U.S. Pat. No.

3,015,011 which issued Dec. 26, 1961. In this instance, the switch contacts are again mounted to a fixed mounting plate and to a leaf spring arm, the upper end of which projects outwardly into the path of the centrifugal actuator. The contact enclosure provided includes a stepped cylindrical member which includes an outer cylindrical end fitted within a cup-shaped mounting member, which is connected to the spring arm. The opposite end of the enclosure includes a similar cylindrical end of a substantially lesser diameter and connected to the first cylindrical end by a lateral flat wall which is integral with the two ends to form the stepped enclosure. The second end is secured to the mounting plate encircling the fixed contact. The total assembly is described as being free of cement or the like to permit limited breathing while preventing movement of contaminants into the enclosure. In operation, the lateral flat wall joining the two radially spaced end mounting wall circular structure defines first and second junctions and pivot connection which permit the collapsing of the assembly at the two connections with the wall moving to a Z-shaped configuration.

Additional prior art teachings are disclosed in the prior art cited in such patents as well as other references of lesser significance set forth in the accompanying prior art disclosure statement submitted herewith. Various problems are associated with dust-proof contact enclosures particularly in the start switch assembly for induction motors. The motor switch assembly is subjected to a large number of cycles over the life of the motor, and conductive arcs are created during the opening and closing of the contacts. The material of the enclosure must maintain the original characteristic over the life of the switch assembly.

Notwithstanding the prior art teaching, there is a need for a low cost improved contact enclosure which minimizes the loading on the spring arm to permit essentially unrestricted movement of the movable contact while establishing a highly effective enclosure to protect the contacts from contaminants in the surrounding environment. The enclosure must be flexible and operate for many switching cycles in the arcing environments of motor start switch assemblies and the like.

SUMMARY OF THE PRESENT INVENTION

The present invention is directed to an enclosed switch contact assembly and particularly to such a switch contact assembly forming an integrated part of a motor such as a single phase induction motor. Generally, the switch assembly includes relatively movable aligned contacts having a tubular enclosure generally referred to herein as a boot, with the opposite ends coupled with the contact supports to enclose the contacts. In accordance with this invention, the tubular boot includes an intermediate convoluted portion establishing at least one C-shaped cross-section which establishes essentially unrestricted movement of the boot and coupled contacts. The boot fully protects the contacts against airborne contaminants such as airborne particles, moisture and the like.

More particularly, the boot is on an elongated tubular member formed of a suitable elastomeric material and having first and second cylindrical ends interconnected by an intermediate convoluted portion. The ends are formed with internal circular openings for telescoping over the aligned contacts for sealing of the space between the contacts. In one embodiment, the one end has an inner diameter slightly smaller than that of the other, such that one end can frictionally engage the moving contact and the other telescopes freely over the other contact. The axial length of the boot is slightly in excess of the maximum spacing of the two contacts such that the convoluted portion is deflected between the two contacts and maintained under compressive forces at all times with the movement of the movable contact. The convoluted portion creates a highly deflectable portion establishing minimal compressive forces but sufficient to establish a firm connection to the contacts and associated supports.

As applied to the centrifugal switch assembly of an induction motor, a mounting plate secures the switch assembly within the motor housing. The fixed contact is secured to the plate by a bracket having a flat wall about the contact. A leaf spring contact arm is secured to said mounting plate with an outer free end generally aligned with the fixed contact and with an outer movable contact aligned with the fixed contact. The speed responsive actuator is coupled to said motor rotor and selectively engages the leaf spring to open and close the contacts. The tubular boot is formed of a silicone rubber with the one end frictionally gripping the movable contact and the opposite cylindrical end of the boot telescoped over the fixed contact and abutting the flat wall on the bracket. The boot is compressively held between the spring arm and the fixed contact bracket.

In typical fractional horsepower induction motors, arc temperatures may exceed 1,000° F. The biproducts created by the arc will include contaminants such as ultraviolet light and ozone gases. Various elastomeric materials are rapidly destroyed by ultraviolet light and ozone gases. The inventor has found however that by special processing and forming of a silicone rubber compound, a boot enclosure can be formed which operates within excess of the expected normal life cycle of the centrifugal switch assembly. Generally, in accordance with this aspect of the invention, a silicone rubber compound includes a silicone rubber of about forty durometer, or other suitable flexible characteristics to which iron oxide and peroxide are added. The iron oxide increases the heat resistance characteristic of the material while the peroxide additive improves the curing characteristic. The compound is molded without the use of a mold release which significantly minimizes the present of free uncurred silicone on the exposed surface of the enclosure. In addition, the inventor has discovered that the special treatment of the enclosure prior to assembly will also contributes significantly to the appropriate life of the enclosure under operating conditions. The molded enclosure is post-cured in an oven for 24 hours at 400° F. with air circulation throughout the oven. After curing, the enclosure is thoroughly cleaned in a soluable, rinsable, phosphate free detergent and preferably in an ultrasonic cleaning system. The enclosure is then water rinsed and dried in an air-circulating oven. The final product is maintained, prior to assembly, in a dustfree container for shipping and storage. Applicant has found that the appropriate rubber compound particularly with the post-curing and cleaning results in a long life, reliable enclosure under the severe cycling and arcing environment encountered in fractional horsepower motors and the like.

The present invention provides a low cost dust proof switch enclosure which is particularly effective in the start switch assembly for induction motors and the like.

DESCRIPTION OF THE DRAWING FIGURES

The drawings furnished herewith generally illustrate the best mode presently contemplated for the invention and are described hereinafter.

In the drawings:

FIG. 1 is a partial view of one end of a single phase motor assembled with a centrifugally actuated starting switch assembly having a flexible contact enclosure, illustrating an embodiment of this invention;

FIG. 2 is a view similar to FIG. 1 shown an alternate position of the switch;

FIG. 3 is an enlarged cross-sectional view taken generally on a center plane through the switch contact unit and more clearly illustrating the enclosure and contacts in the switch closed position;

FIG. 4 an enlarged cross-sectional view similar to FIG. 3 with the enclosure and contacts in the open contact position;

FIG. 5 is a side view with parts broken away and section, and illustrating the enclosure in the formed state;

FIG. 6 is a top view of the enclosure shown in FIG. 5; and

FIG. 7 is a flow chart illustrating the processing and forming of the enclosure.

DESCRIPTION OF THE ILLUSTRATED EMBODIMENT

Referring to the drawings and particularly to FIGS. 1 and 2, a fragmentary portion of an induction motor 1 is illustrated including an annular stator 2 mounted within an outer tubular frame 3. The stator 2 includes a magnetic stator core 4 secured to the frame 3. A field winding 5 is wound in the stator core 4. The field winding 5 generally includes a run winding and an offset separate start winding which are interconnected to each other and to power supply as hereinafter described. Because such detail is well known, it is not specifically and separately shown herein. In accordance with conventional practice, a rotor 6 having a rotor shaft 7 is rotatably mounted within the stator 3. The illustrated rotor 6, as widely employed in an A.C. induction motor, includes a cast squirrel-cage winding 8 embedded within the rotor and thus located within the magnetic field of the field winding 5. The motor shaft 7 is supported within a cup-shaped end closure bell 9 secured in abutting relation to the outer end of the tubular motor frame 3. The end bell 9 defines an end chamber 10 within which a centrifugally actuated start switch assembly 11 is located. The switch assembly 11 is electrically connected into circuit with the start winding of winding 5 for selected connection of the start winding into the circuit only during the starting of the motor and until such time as the rotor reaches a predetermined speed prior to normal operating speed. The assembly 11 includes a start switch unit or apparatus 12 which is mounted on a suitable bracket 13 within the end chamber 10 immediately adjacent to the axial end of field winding 5. A centrifugal actuator 14 is located on the motor shaft 7 and in particular includes a hub 15 which is slidably mounted on the shaft 7 and coupled to centrifugal weights 16. The actuator 14 is coupled to switch unit 12 at rest (FIG. 1) and serves to hold the switch unit closed, and connects the start winding into circuit during the initial starting period. At the desired or switching speed, the centrifugal weights 16 move outwardly, as shown in FIG. 2, with a snap action under the force of the rotational centrifugal forces, and provide a corresponding retracting movement of the hub 15 which snaps outwardly from the switch unit 12 to the position of FIG. 2 and opens the circuit of the start winding. The switch assembly other than for the enclosed contact unit is fully disclosed in U.S. Pat. No. 4,419,550 which issued Dec. 6, 1983 and which is assigned to the same assignee as this application. The details of the centrifugal actuator 14 and switch unit 12 may also be of any other known or other desired construction and no further description of the detail of such components is therefore given herein other than as necessary to a full description and understanding of this invention.

The illustrated switch unit 12 generally includes an insulating flat plate 18 secured to the bracket 13. A spring unit 19 is secured to the base plate and carries a movable contact 20 shown as a contact button on the end of cantilevered arm 21. A fixed contact mounting support or bracket 22 is secured to the insulating plate and supports a fixed contact 23, also shown as a contact button. The fixed contact 23 is located in substantially aligned and opposed relation to the movable contact 20 and is selectively engaged by the contact 20 by deflecting of the spring arm 21. A dustproof enclosure 24 is coupled to the contacts 20 and 23 to enclose and protect the contacts from contaminants in the motor environment, and particularly forms an embodiment of the present invention.

The spring unit 19 includes a coupling pad **24*a* located in the path of the actuator hub 15 for selective axial positioning of the spring arm 21 and the interconnected contact button 20 with respect to the fixed contact 23 between an engaging closed switch position of FIG. 1 and a spaced released open switch position of FIG. 2. The contact support 22** of the above patent includes a metal enclosure of a suitable metal to carry magnetic flux and define a magnetic shield around the contacts. Although such enclosure may be incorporated, it is not shown herein for purpose and clarity of illustrating the present invention.

More particularly and as more clearly shown in FIGS. 3 through 6, the boot 24 is a integral tubular member having circular mounting ends 25 and 26 joined by a single convoluted intermediate portion 27 defining a C-shaped cross section and deflection portion in the tubular boot. The circular ends 25 and 26 are respectively coupled to the movable contact 20 and to the fixed contact 23, and in cooperation with the contact support elements 21 and 22, define a complete dust and environment proof enclosure, as more fully developed hereinafter.

The circular end 25 is coupled to the movable contact 20 as follows. The contact 20 is a button type contact having an outer circular periphery. The boot end 25 is a relatively thick self-supporting and stable end member having an internal diameter, in the unstressed state, slightly less than the diameter of the circular contact and having a planar end face **27*a*. In assembly, the contact 20 is forced into the circular end and is interconnected thereto by a resilient frictional engaging interface. The contact is pushed onto the tubular end with the planar end face 27*a* abutting the spring arm 21. The corresponding end of the boot 24 thus moves with the action of the spring arm 21** between the opened and closed positions of the contacts.

The opposite boot end 26 of the boot 24 is again a relatively heavy or thick end member having a circular internal diameter 28 and a flat planar end face 29 and mounted in telescoped overlying relation to the fixed contact 23. The fixed contact 23 is a contact button generally corresponding to the shape and configuration of the movable contact 20. The internal diameter 28 of the end 26 is slightly larger than the external or outer diameter of the contact 23. The circular boot end 26 thus telescopes over the contact 23 with a free space 30 between the inner diameter 28 of the end and the periphery of the contact 23. The flat planar end face 29 of end 26 abuts a corresponding flat planar surface or wall 31 on the mounting bracket 22. The end 26 is provided with a plurality of circumferentially spaced ribs 32. In the illustrated embodiment, four equispaced ribs 32 are shown integrally formed to the end and the adjacent convolution 27.

The integral convolution 27 is a relatively thin wall member and is specially formed of a particular thickness and elasticity. It is particularly selected with a minimum thickness to permit a flexible wall structure which permits relative collapse and expansion of the central or intermediate portion of the boot. However, the thickness is also selected to establish and maintain a compressive action as a result of the deflection and axial movement of the convolution 27. Thus, the unstressed length of the boot 24 is slightly greater than the maximum spacing between the contact mounting bracket 22 and the leaf spring arm 21 with the centrifugal actuator 14 in the released position of FIG. 2; corresponding to the open contact position. The leaf spring 21 establishes a resilient force on the boot collapsing the convolution 27 slightly and establishing a compressive engagement between the interface of the planar end face 29 of boot end 26 and the planar portion or wall 31 of the fixed contact bracket 22. The boot 24 is thus held in position during the complete operative movement of the switch assembly.

In the switch open position of FIGS. 2 and 4, the convolution 27 is expanded to approach its unstressed state. When the motor stops, the centrifugal actuator 14 returns to the stand-still position, deflects the spring arm assembly and interconnected spring arm 21 to close the contacts 20 and 23. The convolution 27 is collapsed to the position shown in FIGS. 1 and 3 with the cantilevered contact arm 21 and the contact 20 moved on a radius from the open position. The radius or line of movement is on a path slightly crossing the center line of the contacts 20 and 23 in the open position. Thus, the boot 24 deflects or collapses to the inside of the radius more than to the outside of the contact path. The flexibility of the wall 27 is such that the movement occurs essentially without any undue or opposing force on the spring arm. Further, in the illustrated embodiment, the closed position is established by the high force action of the centrifugal actuator 14. The compression force of the boot 27 thus acts to open the contacts and functions as the centrifugal 14 actuator moves to the open position of FIG. 2. The boot force thus assists rather than opposes the rapid opening of the contacts as the result of the spring resilient force in the spring arm.

The free space 30 defines a path through which gases and the like can more readily escape from within the enclosure. Although there is a pressure engagement, it is, as previously described, a relatively low pressure condition and consequently the free space and light pressure forces permit some gasses to escape from within the enclosure. This structural arrangement is significant in the environment encountered in induction motors and the like. Thus, normally on a contact opening, an arc, not shown, tends to form between the contacts. Although such arcing is minimized through construction of the contacts and the like, some arcing, particularly in the higher current motors, is generally encountered. Such arcing within the enclosure 24 creates heat which often adversely affects the boot. Further, arcing generates ozone gases and the like as the result of the breakdown within the air environment and such gases can adversely affect the boot. The boot material and boot formation is especially selected and processed in accordance with a further feature and teaching of the present invention to withstand the arcing environment.

The illustrated boot structure particularly with the appropriate material selection has been found to be a highly reliable and effective enclosure of the contact over the normal cycling anticipated in various induction motor applications and typically maintains its effect involving cycling in excess of 100,000 cycles.

The tubular configuration particularly is adapted to a molded fabrication system and can readily use present day technology to mass produce the boot structure at a relatively low cost. The frictional engagement to the one contact in combination with the pressurized engagement with the opposing contact unit provides convenient assembly of the enclosure to form the totally enclosed contact unit.

For optimum construction, the enclosure material is of course significant. The inventor has discovered that a special selection and processing of a silicone boot material produces an acceptionally long life and highly satisfactory enclosure adapted to application in a centrifugally actuated switch assembly forming an integrated part of a single phase switched induction motor.

More particularly, in forming of the boot is specially processed in a particular sequence as diagrammatically illustrated in FIG. 7.

The first step 34 of the process is the forming and molding of the boot and the second step 35 is a special curing process for stabilizing of the boot material.

The first step 34 involves a mixing of uncured silicone rubber 36, iron oxide 38 and peroxide 39 to form a base material for molding. The silicone rubber 36 is selected of a suitable flexibility, such as a forty (40) durometer silicone rubber. The iron oxide is a fine particulate and mixed with the uncured silicone rubber in a sufficient amount to provide improved heat resistant characteristic. Peroxide is added to promote the curing of the silicone rubber in the mold and subsequently. After thorough mixing of the components, the material is molded as at 41 in any conventional molding apparatus 41 to form the boot 24. The molding is specially carried out in suitable mold structure 42 without the use of any release agent in material or the mold. The forming without a release agent minimizes free uncured silicone at the boot surface and particularly the interior surface of the molded boot 24.

Subsequent to the molding of the boot 24, the boots are subjected to a post curing process in step 35. The molded boot 24 is first cured in a heated environment with air movement as at step 43, shown using a suitable conventional air oven unit 44 having air 45 circulating within and through the oven 44. Applicant has found that curing of the molded boot for a period of 24 hours at approximately 400° F. provides essential curing of the boot 24 to a very stable state. The cured molded boot 24 is then thoroughly cleaned as follows. A first cleaning step 46 involves washing of the boot in a suitable cleaning solution. For example, it can be placed in ultrasonic cleaning tank 47 filled with a wash liquid including phosphate free detergent which is completely soluble and rinseable. After ultrasonic cleansing of the surface, the boot 24 is rinsed in water as at 48. An agitator 49 is provided to thoroughly agitate the water and move the water vigorously over the surface of the boot 24 to thoroughly cleanse and remove the cleaning solution. The cleansed boot 24 is then air dried as at 50. Again, a satisfactory drying process involves placing of the rinsed boot in an air circulating oven 51 such as that described with respect to the initial curing. After the final drying, cleansed and dried boot 24 is suitably packaged as at 52 for subsequent storage and transportation prior to assembly. It is preferably packaged within a total dust-free enclosure or container 53 to prevent contaminates accumulating on the surface or the like.

The cleansed and stored boot 24 is then assembled with the switch assembly in a normal production line processing, under a preferred clean environment, to provide the total enclosure of the contacts and thereby forming a contaminant free enclosed start switch particularly adapted for operation and functioning in the environment of single phase induction motors having a start winding in combination with the centrifugally or other form of actuated contact assembly.

The post curing and washing of the molded boot eliminates the presence of particles on or in the boot and outgasses the silicones from the boot. This significantly minimizes any potential for contact contamination as a result of such free particles, gases or the like.

The specially processed boot 24 has been found to produce an extremely long life boot. Thus, the contact unit, constructed in the switch assembly disclosed herein and with the dust-proof boot 24, processed as disclosed herein, has been cycled for 100,000 cycles without deterioration of the boot and contact unit. Such cycling complies with the requirements for induction motors under present day applications requiring an environmental protective enclosure and provides an extremely commercially acceptable and commercially producible dust-proof contact enclosure. The boot 24 thus operates satisfactory in the presence of contact arcing temperatures which may exceed 1,000 degrees Fahrenheit and the boot material is not destroyed by the arc generated contaminants such as ultraviolet light, ozone gases and the like.

Although shown with a free fit of the one end of the boot with the contact, a suitable interference fit of the boot to both of the movable contact and a stationary contact is acceptable. Further, although specifically described in the preferred construction with a single convolution, other form convoluted shapes can be used with single or multiple convolutions or bellows type constructions. It is important however to maintain the necessary pressure engagement of the unit without unduly loading of the switching structure. Generally, however as previously noted, the unit operated in the illustrated embodiment operates in the pressure state to open the contacts and thus acts in appropriate preferred direction.

These and similar modifications in the tubular convoluted boot including material and forming processes can be made within the scope of the claims which particularly define the features and various scopes of the present invention.

Various modes of carrying out the invention are contemplated as being within the scope of the following claims and particularly pointing out and distinctly claiming the subject matter which is regarded as the invention.

I claim:

1. In a dynamoelectric machine having a winding adapted to be selectively connected and disconnected from circuit in response to the speed of the machine, a switch assembly comprising a first contact, a second contact, means connecting said contacts in circuit with said winding, a relatively fixed mounting plate, said first contact being secured to said mounting plate and said plate having a flat planar surface surrounding said contact, a movable contact arm mounted in opposed aligned relation with said first contact, means securing said second contact to said movable arm in opposed aligned relation to said first contact, each of said contacts having an outer cylindrical periphery, a single piece tubular boot having opposite cylindrical tubular end portions and an intermediate convoluted portion defining at least one generally C-shaped deflection portion, said boot having a first end portion telescoped over said second contact and secured to the periphery of said second contact for movement therewith, said boot projecting from said second contact and having said second end portion telescoped over said first contact into compressive abutting engagement with said planar surface of said mounting plate.

2. In the machine of claim 1 wherein said convoluted portion is formed with a relatively thin thickness relative to said end portions and providing increased flexibility of the convoluted portion with respect to said end portions and establishing a minimal opposing force opposing movement of said movable contact arm.

3. In the machine of claim 1 wherein said boot is formed of a silicone rubber having a sufficient degree of flexibility to permit cycling of said movable arm and attached contact for at least 100,000 cycles.

4. In the machine of claim 3 wherein said contacts normally establishing an arc between the contacts upon closing and opening of said contacts, and said silicone rubber material having flexibility and integrity properties maintained in the presence of normal arcing of said contacts.

5. The contact assembly of claim 1 wherein said convoluted portion includes a single convolution.

6. The contact assembly of claim 5 wherein said cover is a single integral element formed of a silicone rubber and having iron oxide embedded within said silicone rubber.

7. In a single phase induction motor assembly including a starting winding adapted to be connected in a start circuit during the starting and automatically disconnected in response to predetermined starting acceleration of said motor rotor, a switch assembly for opening and closing said start circuit, comprising a mounting plate for interconnecting of the switch assembly within said motor housing, said mounting plate providing a substantially rigid mounting of said switch assembly, a fixed stationary contact secured to said mounting plate and defining a relatively stationary contact with respect to said motor, a leaf spring arm structure secured to said mounting plate and including a leaf spring contact arm with an outer free end generally overlying said fixed stationary contact, said arm being biased into spacement from said stationary contact, a contact secured to the free end of said arm in alignment with said stationary contact for selective engagement and disengagement with said contact for closing and opening of the starting circuit for said starting winding, a speed responsive actuator coupled to said motor rotor and having a member engaging said leaf spring contact arm for selective movement of said leaf spring arm to open and close said contacts, a tubular member formed of silicone rubber and having spaced coaxial cylindrical ends and an intermediate convoluted portion integrally formed with said cylindrical ends, said one cylindrical end being related to the diameter of said movable contact and telescoped over said contact with a resilient frictional gripping of the periphery of said contact to define a mechanical attachment of the boot to said movable contact and establishing a fluid tight connection therebetween, the opposite cylindrical end of said tubular boot having an inner diameter slightly greater than the diameter of the fixed contact and adapted to move freely over said contact, the length of said tubular boot being greater than the maximum spacing between said mounting plate and the movable contact whereby said tubular boot is held between said mounting plate with a deflection of said convoluted portion to establish a compressive engagement with the mounting plate and thereby establishing support of the boot with an essentially sealing enclosure of said contacts.

8. A switch contact assembly comprising a support member formed of an electrical insulating material and having a planar portion, a first contact fixed to said support member abutting said planar portion, a cantilevered arm having a resilient portion secured at one end to said support member and extending outwardly therefrom into overlying alignment with said first contact, a second contact secured to said arm and alignment with said first contact, an elongated tubular cover formed of an elastomeric material and having first and second circular ends interconnected by an intermediate convoluted portion, said circular ends having internal circular openings, with said first circular end having an inner diameter slightly smaller than the diameter of said second contact and the second circular end having an internal diameter greater than the diameter of said first contact, said boot having an axial length in excess of the maximum spacing of said arm from said planar portion of said support member, the first circular end telescoped into resilient frictional engagement with said second contact and extending outwardly therefrom with said second enlarged diameter circular end telescoped freely over said first contact and into sealing abutting engagement with said planar portion, said convoluted portion being deformed between said planar portion and said movable second contact and maintained under compressive forces at all times with the movement of the movable second contact, said convoluted portion providing a highly deformable portion establishing an essentially minimal compressive forces sufficient to establish a firm connection to said planar portion and minimal opposing force on the spring cantilevered arm and thereby permitting the essentially unrestricted opening and closing of said contacts and simultaneously maintaining the contacts isolated from the foreign substances of the surrounding environment.

9. The contact assembly of claim 8 wherein said cover is a single piece integral member formed of flexible plastic material and said first and second circular ends have a substantially greater thickness than said convoluted portion.

10. The contact assembly of claim 9 wherein said first circular end has a lesser thickness than said second circular end.

11. The contact assembly of claim 8 wherein said convoluted portion includes a single convolution.

12. The contact assembly of claim 8 wherein said cover is a single integral element formed of a silicone rubber and having iron oxide embedded within said silicone rubber.

* * * * *